US006039531A

United States Patent [19]

Suenaga et al.

[11] Patent Number: 6,039,531

[45] Date of Patent: Mar. 21, 2000

[54] GAS TURBINE BLADE

[75] Inventors: Kiyoshi Suenaga; Yasuoki Tomita; Hiroki Fukuno, all of Takasago, Japan

[73] Assignee: Mitsubishi Heavy Industries, Ltd., Tokyo, Japan

[21] Appl. No.: 09/034,130

[22] Filed: Mar. 3, 1998

[30] Foreign Application Priority Data

Mar. 4, 1997 [JP] Japan ..... 9-049031

[51] Int. Cl.[7] ..... F01D 5/18; F01D 5/20

[52] U.S. Cl. ..... 415/115; 415/173.1; 415/173.5; 416/96 R

[58] Field of Search ..... 415/115, 173.1, 415/173.4, 173.5; 416/92, 96 R, 96 A, 97 R, 97 A, 224

[56] References Cited

U.S. PATENT DOCUMENTS

| | | | |
|---|---|---|---|
| 3,854,842 | 12/1974 | Caudill | 416/97 R |
| 4,390,320 | 6/1983 | Eiswerth | 416/97 R |
| 4,424,001 | 1/1984 | North et al. | 416/92 |
| 5,261,789 | 11/1993 | Butts et al. | 416/96 R |

FOREIGN PATENT DOCUMENTS

| | | | |
|---|---|---|---|
| 35 07 578 | 9/1985 | Germany . | |
| 62-223402 | 10/1987 | Japan | 416/96 R |
| 2155558 | 9/1985 | United Kingdom | 415/173.1 |

*Primary Examiner*—Christopher Verdier
*Attorney, Agent, or Firm*—Alston & Bird LLP

[57] ABSTRACT

The present disclosure provides a gas turbine blade in which the tip end thereof is cooled effectively to decrease the metal temperature for the prevention of burning and the temperature gradient of blade metal is decreased to prevent the occurrence of cracking. In the gas turbine blade provided with a cooling passage therein, a protrusion is provided inwardly of the peripheral walls of the blade, which define the blade profile and the protrusion is positioned on the outer surface of blade tip end wall directly above a cooling passage within the blade.

3 Claims, 5 Drawing Sheets

GAS TURBINE BLADE

FIELD OF THE INVENTION AND RELATED ART STATEMENT

The present invention relates to a gas turbine blade in which a blade tip end is cooled effectively.

As shown in FIG. 4, a conventional cooled blade used for a high-temperature gas turbine is provided with a protrusion 101*a* at the tip end of the cooled gas turbine blade 102. This protrusion 101*a* has a sealing effect such that a gap between the tip end of the gas turbine blade 102 and a turbine blade ring 103 as shown in FIGS. 5 and 6 is minimized to keep the quantity of main flow gas which leaks and causes a turbine loss to a minimum, and also is provided as an allowance so that even if the tip end of the turbine blade 102 comes into contact with the turbine blade ring 103 due to thermal deformation etc., various problems such as damage to discharge of the blade, the cooling medium from the blade cooling passage, and/or i.e., oxidation, burning of the blade can be prevented. This conventional protrusion 101*a* is provided on the extension of blade profile over the whole periphery the outer surface of the blade tip end face and has the same shape as that of the blade 102, as shown in FIGS. 4 and 5.

Conventionally, a cooled blade for a gas turbine, in which cooling is effected by allowing a cooling medium to flow in a cooling passage in the blade, has been used. As the turbine inlet temperature and pressure have been increasing year by year to improve the gas turbine performance, the thermal load on the cooled blade for the gas turbine has also been increasing. Therefore, the blade metal temperature has been decreased to prevent burning of the blade. As a result, however, a very large temperature gradient occurs in the blade metal. For this reason, the protrusion 101*a* as shown in FIG. 4 has been provided at the tip end of the gas turbine blade. In this case, since the distance of the protrusion from the cooling surface formed on the interior surface of the cooling passage in the blade is large, the metal temperature at the tip end of the protrusion is very high, so that there is a possibility of the occurrence of burning of the protrusion and a the formation of a crack as a result of the thermal stress caused by the temperature difference between the blade metal and the cooling portion.

For this reason, a further blade modification as shown in FIG. 6, involves ejection of a cooling medium 106 from a cooling passage 104 provided in the gas turbine blade 102 through film cooling holes 105 so that the cooling medium 106 is directed toward the blade tip end and the turbine blade ring 103 at the outside periphery of the blade, so that a low-temperature cooling medium film is formed to cool the gas turbine blade 102. However, since the ejected cooling medium 106 causes the turbine performance to decrease, and consequently the quantity of the ejected cooling medium 106 must be restricted.

OBJECT AND SUMMARY OF THE INVENTION

An object of the present invention is to solve the problems with the above-described conventional gas turbine blade.

The present invention provides a gas turbine blade provided with a cooling passage therein, in which a cooling protrusion is provided on the outer surface of the blade tip end wall. The cooling protrusion comprises arcuate spaced apart walls that generally oppose each other and which collectively define a substantially closed wall positioned inwardly of, and substantially corresponding to, the blade profile.

In particular according to the present invention, the protrusion is provided on the outer surface of blade tip end wall, and inwardly of an extension of the walls defining the blade profile so as to be close to the cooling passage in the gas turbine blade as a result of being positioned directly above the cooling passage, so that the distance from the blade cooling passage, which defines a cooling surface, on the blade interior is short as compared with the distance between the passage and protrusion in the conventional gas turbine blade, so that the metal temperature of the protrusion tip end is decreased. This decrease in temperature prevents the burning, i.e., oxidation of the gas turbine blade metal. Also, since the material strength is relatively increased as compared with the conventional gas turbine blade, and the thermal stress is decreased by the decrease in temperature difference between the blade metal and the blade cooling portion, the propagation of cracks at the blade tip end can be avoided.

According to the gas turbine blade in accordance with the present invention, the protrusion provided inwardly of the exterior of the blade profile on the outer surface of blade tip end wall can enhance the cooling performance of the gas turbine blade, which contributes to the increase in reliability without impairing the performance of the whole plant.

BRIEF DESCRIPTION OF THE DRAWINGS

FIG. 4(*b*) is a top plan view of the tip end of the conventional gas turbine blade shown in FIG. 4(*a*);

FIG. 7(*b*) is a schematic view showing a distance from the cooling surface at the blade tip end of the conventional gas turbine blade;

and FIG. 7(*c*) is a schematic view showing a distance from the cooling surface at the blade tip end of the gas turbine blade of the present invention.

DETAILED DESCRIPTION OF PREFERRED EMBODIMENTS

Figure 1A:
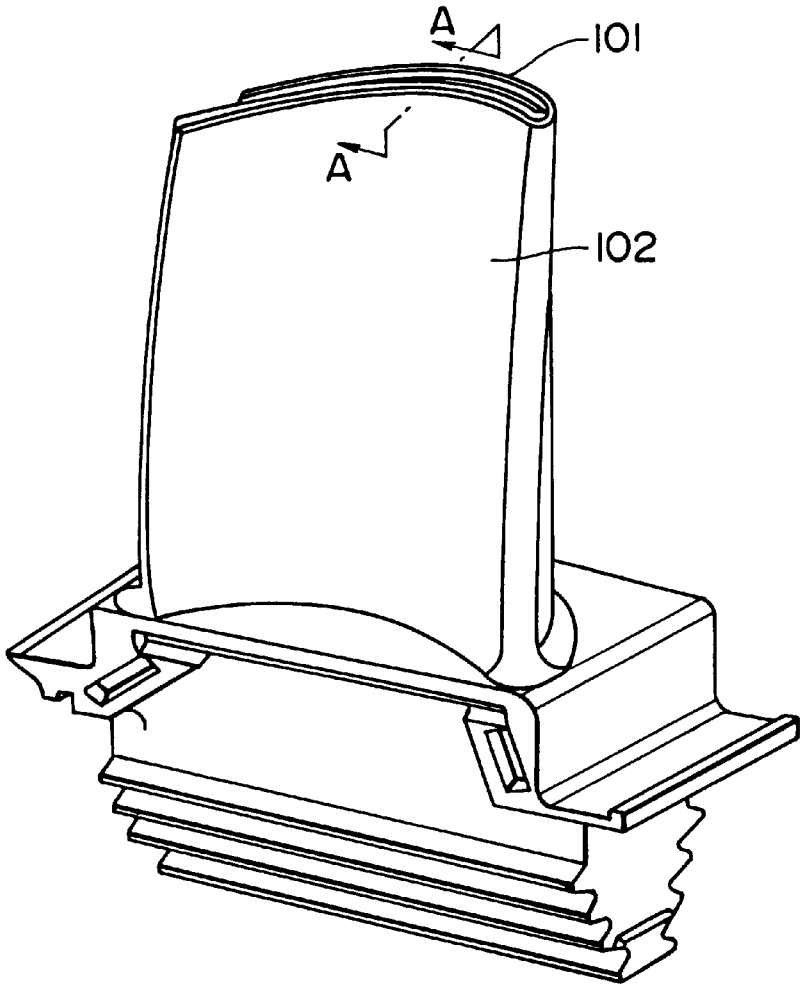
FIG. 1(*a*) is a perspective view showing a first embodiment of a gas turbine blade in accordance with the present invention, and FIG. 1(*b*) is a top plan view of the tip end of the gas turbine blade shown in FIG. 1(*a*)
Figure 1B:
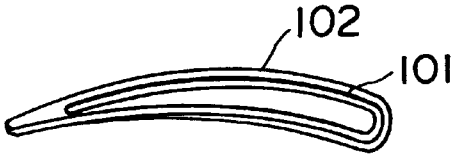
Figure 2:
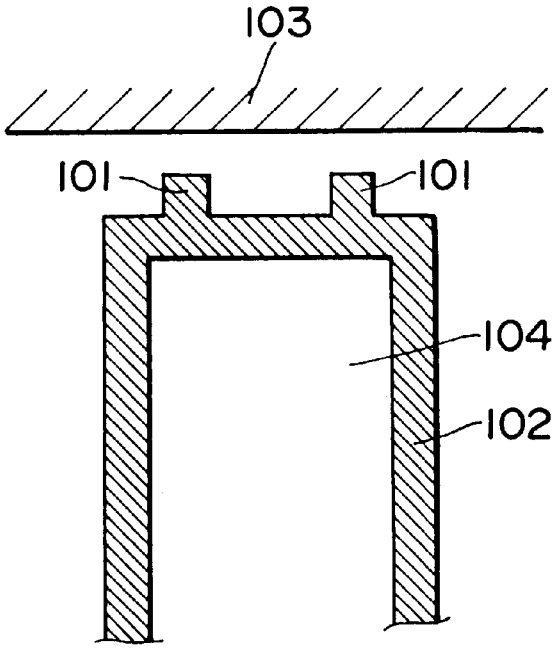
FIG. 2 is a sectional view taken along the line A—A of FIG. 1(*a*)

A first embodiment of a gas turbine blade in accordance with the present invention will be described with reference to FIGS. 1 and 2. In this embodiment, a cooling passage 104, which is the same as that of the conventional gas turbine blade shown in FIGS. 4 and 5, is provided in a gas turbine blade 102, and a protrusion 101 protruding toward a turbine blade ring 103 is provided on the outer surface of the tip end face of the gas turbine blade 102.

The protrusion 101 is provided so as to be substantially similar in shape to that of the blade profile comprises a substantially closed wall having spaced apart wall portions extending around the tip end portion of the blade 102, but the protrusion is positioned inwardly from the interior of blade profile. Also, the height of the protrusion 101 is determined so that a gap between the protrusion 101 and the turbine blade ring 103 is minimized.

In particular , the protrusion 101, which is substantially similar in shape to the blade profile, is positioned on the upper end face of the blade tip end and also inwardly of spaced arcuate blade walls that collectively form the blade profile on the. Therefore, the protrusion 101 is positioned directly above the cooling passage 104 so as to be close to the cooling passage 104, which can decrease the metal temperature of the protrusion 101.

Figure 4A:
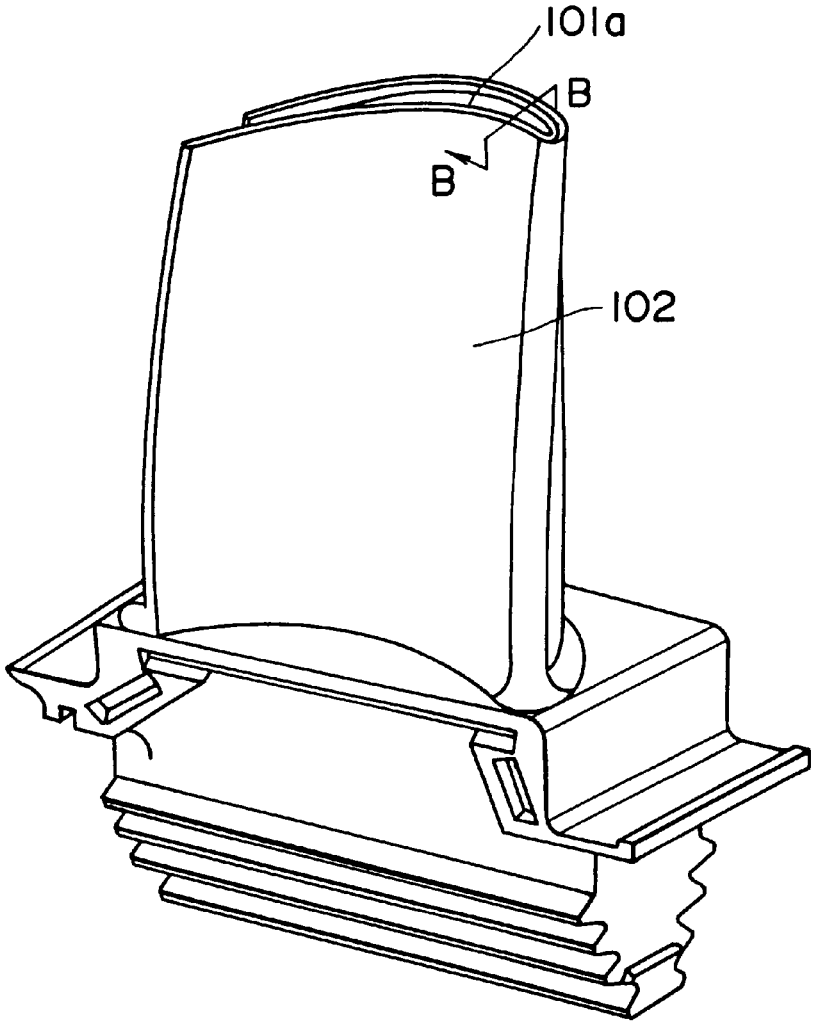
FIG. 4a. (PRIOR ART)
FIG. 4(*a*) is a perspective view of a conventional gas turbine blade.
Figure 4B:
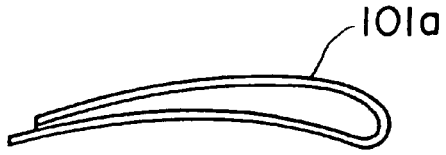
FIG. 4b. (PRIOR ART)
Figure 5:
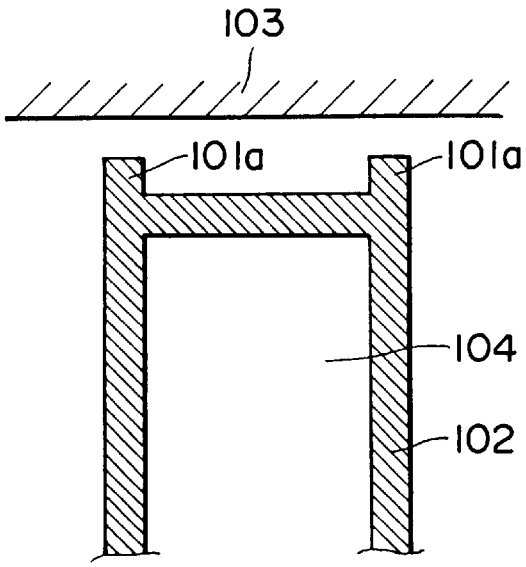
FIG. 5. (PRIOR ART)
FIG. 5 is a sectional view taken along the line B—B of FIG. 4, at the tip end of the conventional gas turbine blade.
Figure 6:
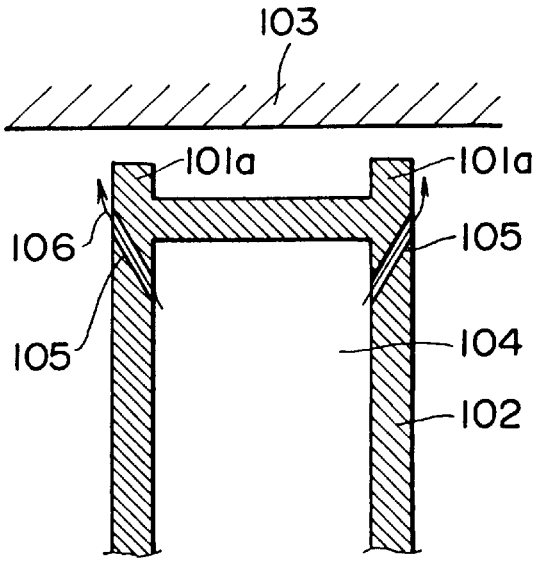
FIG. 6. (PRIOR ART)
FIG. 6 is a sectional view of the tip end of a conventional gas turbine blade similar to that of FIGS. 4(*a*) and 4(*b*) but modified in that the conventional gas turbine blade has been provided with film cooling holes.
Figure 7A:
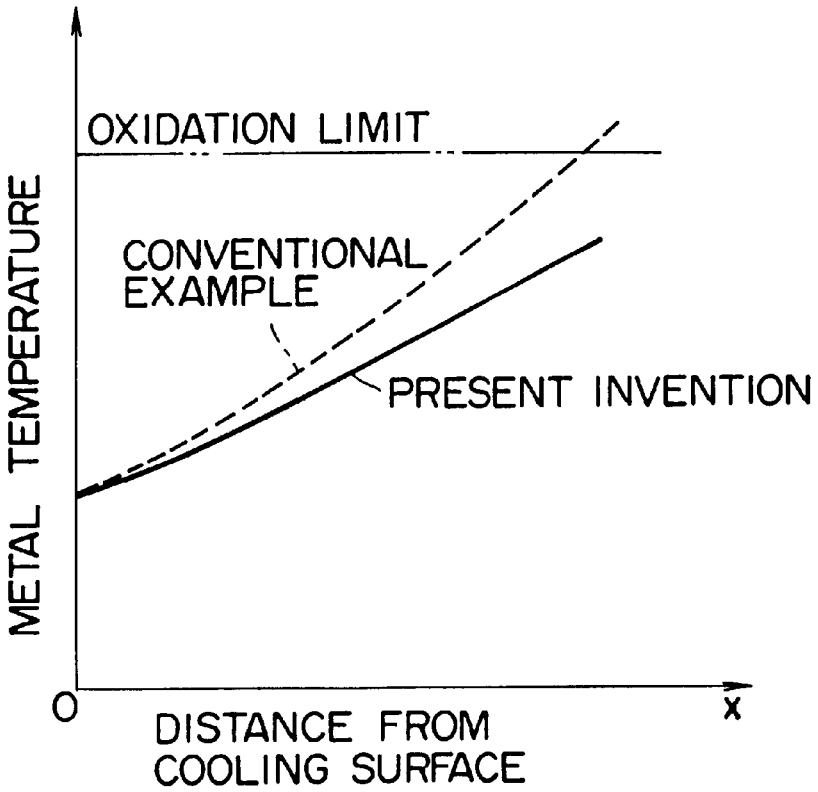
FIG. 7(*a*) is a diagram showing the metal temperature of the blade tip end and protrusion of the gas turbine blade of the first embodiment in accordance with the present invention and the conventional gas turbine blade shown in FIGS. 4 and 5.
Figure 7B:
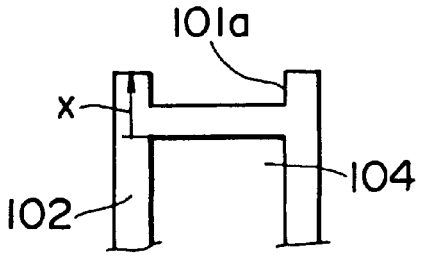
FIG. 7b. (PRIOR ART)
Figure 7C:
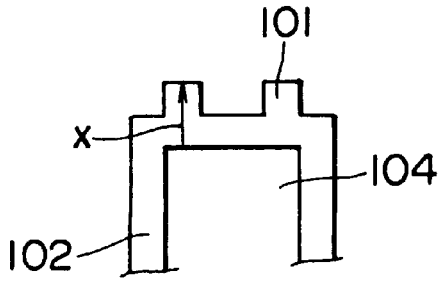

FIG. 7 shows the metal temperature at the blade tip end near the protrusion 101 of the blade 102 of this embodiment and the temperature of the blade tip end neat the protrusion 101*a* of the conventional blade 102 example shown in FIGS. 4 and 5. As indicated by the solid line in FIG. 7(*a*), in the embodiment of the present invention shown in FIGS. 1 and 2, the metal temperature of the tip end of the gas turbine blade 102 and the protrusion 101 can be decreased as compared with the conventional blade example, the temperature thereof being indicated by the broken line of FIG. 7*a*. Thereupon, the burning of the gas turbine blade 102 can be avoided, and the occurrence of cracking at the tip end of the gas turbine blade 102 can be avoided thereby relatively increasing the material strength and decreasing the thermal stress.

Figure 3:
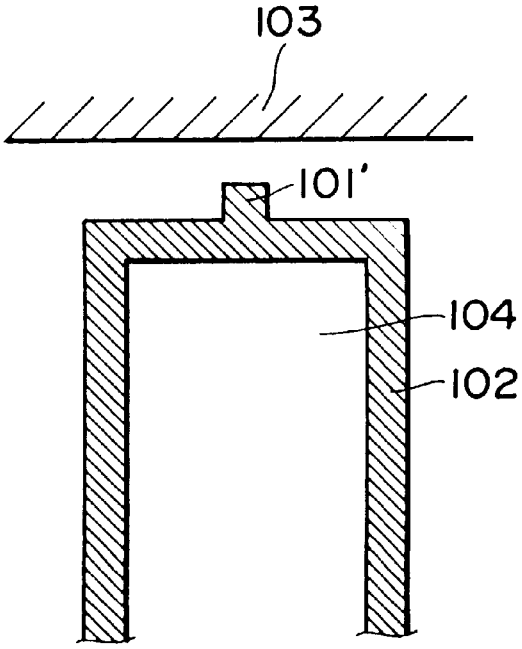
FIG. 3 is a sectional view of the tip end of a gas turbine blade in accordance with a second embodiment of the present invention.

A second embodiment of a gas turbine blade in accordance with the present invention will be described with reference to FIG. 3. In this embodiment, one linear protrusion 101' protruding toward the turbine blade ring 103 is provided along the blade width center on the outer surface of the end face of the gas turbine blade 102 in place of the protrusion 101 in the first embodiment of the present invention.

This embodiment achieves the same operation and effects as those of the first embodiment of the present invention.

Although one linear protrusion 101' is provided along the blade width center on the outer surface of the end face of the gas turbine blade 102 in the second embodiment of the present invention, a plurality of protrusions may be provided along the blade width on the inside from the extension of blade profile on the outer surface of the end face of the gas turbine blade 102.

We claim:

1. A gas turbine blade comprising:

a blade having a tip end portion defined by arcuate spaced-apart wall portions which generally oppose one another and a cooling passage formed in the blade tip end portion between the wall portions, the wall portions having outer surfaces which collectively define a blade profile, the blade further including a tip end wall which extends between the blade wall portions at the tip end portion of the blade; and a protrusion formed on an outer surface of the tip end wall, said protrusion having a shape corresponding generally to said blade profile and being defined by a substantially closed wall comprising opposed spaced apart wall portions positioned on said end wall inwardly of the blade profile and directly above said cooling passage wherein said cooling passage is closed at said tip end portion of said blade.

2. The gas turbine blade of claim 1 wherein said protrusion wall comprises an open portion adjacent the trailing end of said blade.

3. The gas turbine blade of claim 1 in which said protrusion has a height extending a distance such that a gap between the protrusion and a turbine blade ring exterior of said turbine blade, is minimized.

* * * * *